US010190839B1

(12) United States Patent
Lee

(10) Patent No.: US 10,190,839 B1
(45) Date of Patent: Jan. 29, 2019

(54) FIREARM BARREL ALIGNMENT GUIDE

(71) Applicant: Darryl S. Lee, Fort Myers, FL (US)

(72) Inventor: Darryl S. Lee, Fort Myers, FL (US)

( * ) Notice: Subject to any disclaimer, the term of this patent is extended or adjusted under 35 U.S.C. 154(b) by 6 days.

(21) Appl. No.: 15/642,467

(22) Filed: Jul. 6, 2017

Related U.S. Application Data

(63) Continuation of application No. 15/499,430, filed on Apr. 27, 2017, now Pat. No. 10,066,890.

(51) Int. Cl.
*F41A 21/32* (2006.01)
*F41A 21/30* (2006.01)

(52) U.S. Cl.
CPC ..... *F41A 21/325* (2013.01); *F41A 21/30* (2013.01)

(58) Field of Classification Search
CPC ..... F41A 21/00; F41A 21/30–21/42
USPC ..... 42/76.01, 79; 89/14.2–14.4; 181/223
See application file for complete search history.

(56) References Cited

U.S. PATENT DOCUMENTS 2,351,037 A * 6/1944 Green ..... F41A 21/34 89/14.5
2,866,288 A * 12/1958 Herter ..... F41A 21/42 42/79
3,710,679 A * 1/1973 Werbell, III ..... F41A 21/30 89/14.4
3,797,155 A * 3/1974 Smith ..... F41A 21/42 42/79
4,510,843 A * 4/1985 Rabatin ..... F41A 21/325 89/14.4
4,879,942 A * 11/1989 Cave ..... F41A 21/36 89/14.3
4,939,977 A * 7/1990 Stroup ..... F41A 21/30 89/14.4
5,679,916 A * 10/1997 Weichert ..... F41A 21/30 181/223
5,794,374 A * 8/1998 Crandall ..... F41A 21/36 42/76.01
6,769,346 B2 * 8/2004 Rosenthal ..... F41A 21/28 89/14.3
6,973,863 B1 * 12/2005 Jones ..... F41A 21/26 89/14.2
8,752,324 B2 * 6/2014 Muller ..... F41A 21/40 42/79
8,973,481 B2 * 3/2015 Dueck ..... F41A 21/325 181/223
9,500,427 B1 * 11/2016 Larue ..... F41A 21/30
2016/0097609 A1 * 4/2016 Penchuk ..... F41A 21/325 42/76.01

* cited by examiner

*Primary Examiner* — Stephen Johnson
*Assistant Examiner* — Benjamin S Gomberg
(74) *Attorney, Agent, or Firm* — Nicholas Pfeifer; Smith & Hopen, P.A.

(57) ABSTRACT

A firearm barrel alignment device and method of use for quickly and accurately axially aligning an adapter with the barrel of a firearm. The novel barrel alignment device attaches to or is integrated with an adapter and includes an angled or inwardly curved funnel to guide the muzzle of a firearm barrel. The firearm barrel alignment device is heat resistant, preferably, in excess of 1300 degrees Fahrenheit. Moreover, the funnel in the firearm barrel alignment device is adapted to create a seal between the muzzle and the firearm barrel alignment device.

19 Claims, 8 Drawing Sheets

FIREARM BARREL ALIGNMENT GUIDE

CROSS-REFERENCE TO RELATED APPLICATIONS

This nonprovisional application is a continuation of and claims priority to nonprovisional application Ser. No. 15/499,430, entitled "FIREARM SUPPRESSOR ADAPTER," filed Apr. 27, 2017 by the same inventor.

BACKGROUND OF THE INVENTION

1. Field of the Invention

This invention relates, generally, to firearms adapters. More specifically, it relates to a system and method for aligning a firearm barrel with a firearm adapter.

2. Brief Description of the Prior Art

Existing firearm adapters typically include an inner surface having a flat and circular cross-section that is intended to mate with the barrel of a firearm. Most firearm barrels, however, are not perfectly cylindrical and include geometric inconsistencies on their external surfaces. Additionally, these firearm adapters usually include a flat front wall that provides a frontal stop for the muzzle end of a barrel. In other words, the adapter receives the muzzle end of the firearm and is slid in a proximal direction, towards the grip of the firearm, until the muzzle end abuts the flat front wall of the adapter. Again, the production of firearms rarely produces a muzzle end that is perfectly perpendicular to the outer lateral surface of the barrel. As a result, it is difficult to secure a firearm adapter in axial alignment with the barrel of a firearm and ensure that a seal is created between the muzzle and the front wall of the adapter.

Consequently, individual adapters are designed to fit a single geometry barrel and are generally incapable of attaching to barrels of different dimensions because of the difficulty in axially aligning the adapter and the barrel. Retailers and manufacturers are thus required to spend a substantial sum on the manufacturing, distribution, and stocking of various firearm adapters.

Accordingly, what is needed is a barrel alignment device for use with a firearm adapter that can quickly and accurately axially align an adapter with the barrel of a firearm. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a barrel alignment device for use with a firearm adapter that can quickly and accurately axially align an adapter with the barrel of a firearm. is now met by a new, useful, and nonobvious invention.

An embodiment of the firearm barrel alignment device includes a proximal end, a distal end, and a body extending therebetween. A projectile aperture is aligned with a longitudinal axis the body and the body includes a funnel with an inner surface that is tapered in a distal direction. The distal end of the funnel terminates at the projectile aperture and the inner surface of the funnel is preferably heat resistant to temperatures in excess of 1300 degrees Fahrenheit.

An embodiment includes a compressible material disposed on the inner surface of the funnel to provide a seal between the funnel and the muzzle of the firearm barrel. In an embodiment, the funnel has a free end at the proximal or distal end of the funnel, thereby allowing the funnel to flex when subject to an axial force from the firearm barrel and aid in creating a seal between the funnel and the muzzle. Another embodiment may include a cavity disposed in the body at a location that is axially and radially distal from the inner surface of the funnel, which allows the funnel to flex under an axial force and aid in creating a seal between the funnel and the muzzle.

An embodiment includes threads on the body for attaching to a firearm adapter. It is considered that that the firearm barrel alignment guide may be secured to a firearm adapter using any fastening method known to a person having ordinary skill in the art or may be directly integrated into the firearm adapter.

An embodiment includes a firearm barrel alignment guide assembly having a firearm adapter configured to attach to a firearm and a barrel alignment guide attached to the firearm adapter. The firearm barrel alignment guide has a proximal end, a distal end, and a body extending therebetween. The firearm barrel alignment guide further includes a projectile aperture aligned with a longitudinal axis the body and a funnel having an inner surface that is tapered in a distal direction. The distal end of the funnel terminates at the projectile aperture.

In an embodiment, the inner surface of the funnel is heat resistant to temperatures in excess of 1300 degrees Fahrenheit. An embodiment may further include a compressible material disposed on the inner surface of the funnel.

In an embodiment, the funnel has a free end at the proximal or distal end of the funnel, thereby allowing the funnel to flex when subject to an axial force from a barrel of a firearm. Alternatively, or in addition to, an embodiment may include a cavity disposed in the body at a location that is axially and radially distal from the inner surface of the funnel.

An embodiment of the novel method for aligning a firearm barrel to a firearm adapter includes securing a firearm barrel alignment guide to a firearm adapter, inserting the firearm barrel into the firearm adapter until the firearm barrel contacts the inner surface of the funnel and is guided into axial alignment with the firearm adapter, and securing the firearm adapter to the firearm.

In an embodiment, the novel method may include the additional step of measuring the outer diameter of the firearm barrel and selecting a firearm barrel alignment guide having a funnel with a minimum diameter that is greater than the outer diameter of the firearm barrel.

An object of the invention is to provide an easy-to-use, firearm barrel alignment guide that can quickly, accurately, securely, and concentrically align the barrel of a firearm with the firearm adapter.

An object of the invention is to provide a firearm barrel alignment guide configured to fit most firearms on the market and properly aligned the barrel of the firearm with a firearm adapter.

It is another object of the invention to provide a firearm barrel alignment guide that is far less costly to manufacture due to a one size fits all system, and to eliminate the need to manufacture hundreds of sizes and configurations.

In addition, it is an object of this invention to provide a firearm barrel alignment guide that can be secured to, or integrated with, a suppressor, a suppressor extension, and/or firearm accessories that are preferably aligned with the barrel of a firearm.

It is another object of the invention to provide a firearm barrel alignment guide that is configured to seal the muzzle of the barrel with the firearm barrel alignment guide.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The term "funnel" as used herein is intended to describe a structure that is tapered. The funnel is preferably frustoconical-shaped and may be comprised of a single structure or several interconnected members. In addition, the structure may include several longitudinally extending slots in a single structure, which permits the structure to flex and adjust in diameter when subject to a barrel being forced into the structure in an axial direction. Furthermore, the structure may have a shape other than frustoconical so long as the aperture in the structure tapers from the proximal end to the distal end. The funnel can be as simple as a hollow cone shaped structure having sloped walls preferably between 10 and 80 degrees of slope.

Figure 1:
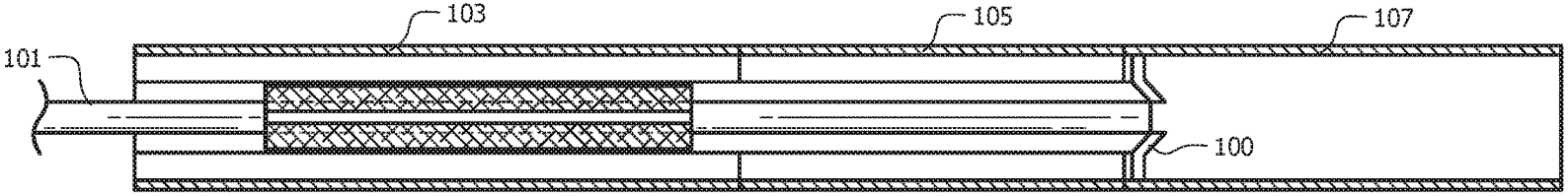
FIG. 1 is a cross-sectional elevation view of an embodiment of the present invention.

The present invention includes a firearm barrel alignment guide configured to guide a firearm barrel into alignment with a firearm adapter or firearm accessory without the need of any additional tools or modifications to the barrel of the firearm. As depicted in FIG. 1, an embodiment of firearm barrel alignment guide 100 can be attached to suppressor 107, which in turn is secured to extension 105 and adapter 103. Adapter 103 ensleeves barrel 101 and firearm barrel alignment guide 100 ensures that barrel 101 is axially aligned with suppressor 107, extension 105, and adapter 103. While FIG. 1 depicts firearm barrel alignment guide 100 secured to suppressor 107, firearm barrel alignment guide 100 may be secured to extension 105 or adapter 103. Ultimately, the muzzle end of barrel 101 preferably contacts firearm barrel alignment guide 100, so firearm barrel alignment guide 100 is preferably secured to a particular firearm adapter or firearm accessory at the intended resting location for the muzzle end of barrel 101.

Firearm barrel alignment guide 100 allows a user to quickly and efficiently install and align firearm adapter/accessory 103 to gun barrel 101. Firearm barrel alignment guide 100 is adapted to guide the muzzle into alignment with firearm adapter/accessory 103 using, for example, distally and inwardly tapered funnel 106. Funnel 106 extends inwardly to catch the muzzle of barrel 101 without extending inwardly far enough towards the longitudinal axis to impede a bullet exiting barrel 101.

As depicted in the figures, firearm barrel alignment guide 100 includes a, preferably circular, projectile aperture 102 centrally aligned with the longitudinal axis of firearm barrel alignment guide 100. Projectile aperture 102 provides the outlet through which a projectile can exit barrel 101 and contact the intended target. The most common projectiles range from a .17 caliber projectile to a .50 caliber projectile, which have outer diameters generally between 0.17 and 0.5 inches. Thus, projectile aperture 102 must have a diameter that is greater than about 0.17 inches to accommodate a majority of the typical projectiles. The outer diameter of firearm barrels is typically between 0.5 inches and 1.05 inches. Projectile aperture 102 must be less than the outer diameter of the barrel, but greater than the outer diameter of the projectile. Therefore, an embodiment of firearm barrel alignment guide 100 includes projectile aperture 102 having a diameter between roughly 0.5 inches and 1.05 inches to ensure that the muzzle end of barrel 101 contacts firearm barrel alignment guide 100 rather than simply passing through projectile aperture 102. An embodiment may include projectile aperture 102 having a diameter between about 0.375 inches and 1.1 inches to account for barrels and firearm projectiles of less common sizes. Because there are often some minor deviations in the outer diameter of projectiles of the same caliber and barrel bore diameters, the dimensions provided herein may vary by several $100^{th}$ of an inch and still be considered to fall within the ranges disclosed.

Referring now to FIG. 2, projectile aperture 102 is defined by free end 104 of funnel 106. Funnel 106 is in mechanical communication with firearm adapter/accessory 103 and tapers inwardly in a distal direction to create an inwardly sloped feature to guide the muzzle end of barrel 101 and bring barrel 101 into axial alignment with adapter/accessory 103. As the muzzle end of barrel 101 is forced into contact with funnel 106, the slope of funnel 106 redirects barrel 101 into axial alignment with firearm adapter/accessory 103. Barrel 101 will continue to align about the longitudinal axis of firearm barrel alignment guide 100 and in turn adapter 103, until barrel 101 can no longer move in a distal direction, at which point barrel 101 will be axially aligned with the longitudinal axes of firearm barrel alignment guide 100 and adapter 103.

Figure 2A:
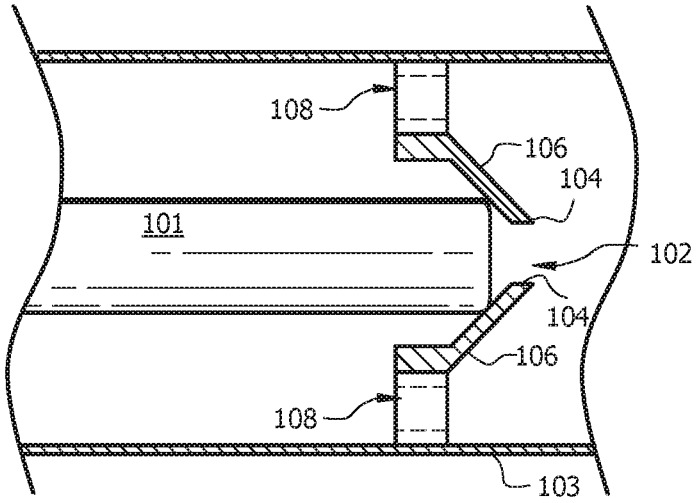
FIG. 2A is a cross-sectional elevation view of an embodiment of the present invention.

The embodiment in FIG. 2A also includes fluid dispersing apertures 108 allowing fluid/gas expelled from the muzzle of barrel 101 to expand backwards and around barrel 101. Allowing the gas from the muzzle blast to expand backwards (i.e. proximally or towards the handle of the firearm) may be desirous when a suppressor extension is in use. The suppressor extension increases the available volume for capturing and cooling the gas expelled after a projectile is fired from the weapon.

Figure 2B:
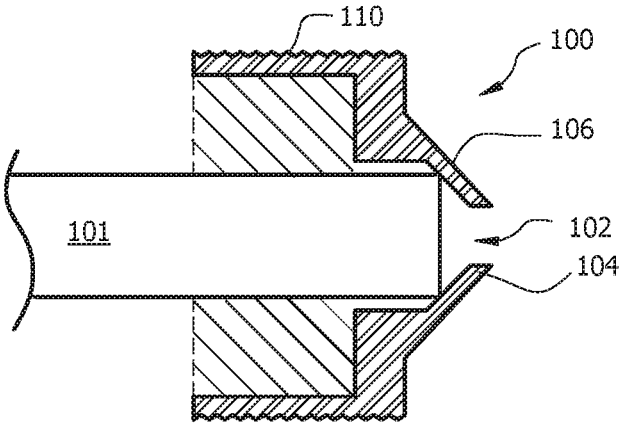
FIG. 2B is a cross-sectional elevation view of an embodiment of the present invention.

Fluid dispersing apertures 108 are preferably located in a portion of firearm barrel alignment guide 100 that is radially beyond the outer surface of barrel 101. Without fluid dispersing apertures 108, the gas expelled from the barrel would be unable to pass into the extension. Firearm barrel alignment guide 100 would thus render the extension superfluous without fluid dispersing apertures 108. Alternatively, firearm barrel alignment guide 100 may lack fluid dispersing apertures 108 as depicted in FIG. 2B.

Firearm barrel alignment guide 100 may be integrated with or secured to firearm adapter/accessory 103 using any attachment method or device known to a person of ordinary skill in the art, including but not limited to welding, adhesives, press fitting, mechanical fasteners, and threaded engagement. Moreover, firearm adapter/accessory 103 may be manufactured with firearm barrel alignment guide 100 integrated into firearm adapter/accessory 103 using, for example, extrusion or additive manufacturing/3D printing. FIG. 2B depicts an embodiment having mechanical threads 110 disposed on the outer diameter of firearm barrel alignment guide 100. Mechanical threads 110 are adapted to engage threads on an internal surface of firearm adapter/accessory 103 (not shown). In an embodiment, the firearm barrel alignment guide may be adapted to thread to an external surface of the firearm adapter/accessory.

Figure 3:
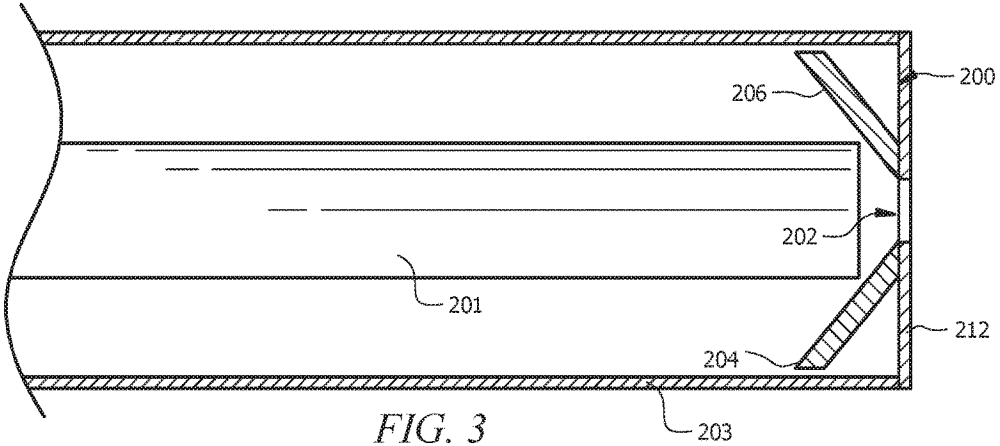
FIG. 3 is a sectional elevation view of an embodiment of the present invention.
Figure 4:
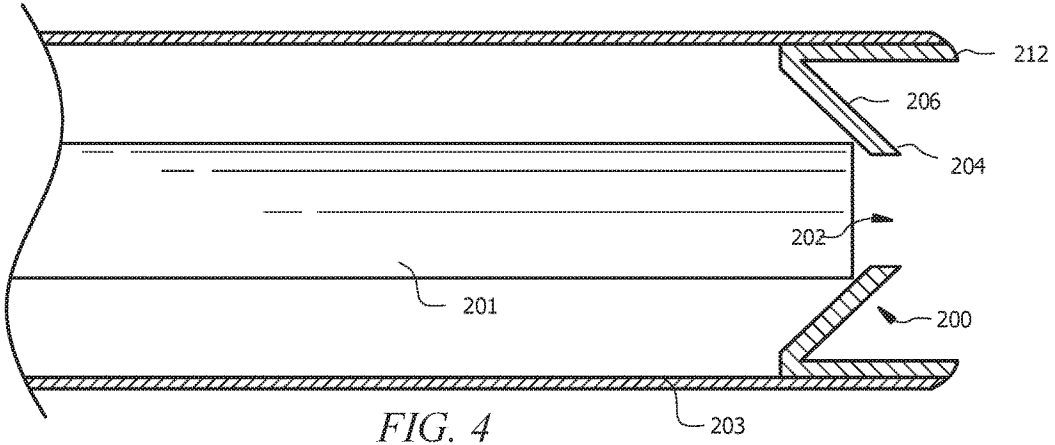
FIG. 4 is a cross-sectional elevation view of an embodiment of the present invention.
Figure 5A:
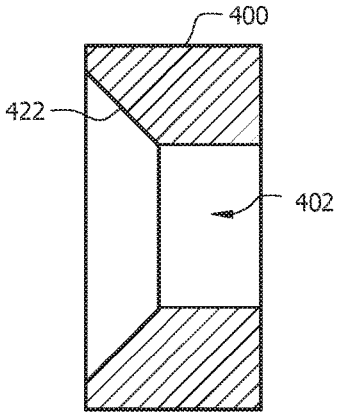
FIG. 5A is a cross-sectional elevation view of an embodiment of the present invention.
Figure 5B:
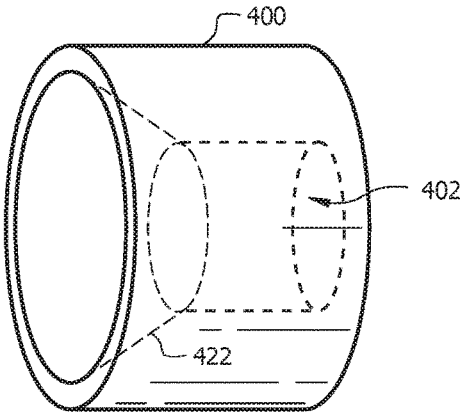
FIG. 5B is a perspective view of the embodiment depicted in FIG. 5A.

FIGS. 3-4 provide additional embodiments, 200 and 300, respectively, that do not include fluid dispersing apertures, however, each embodiment may include said fluid dispersing apertures. Embodiments 200, 300 are minimalistic approaches to firearm barrel alignment guide 100, which include decreased materials, costs, and complexity of manufacturing.

Firearm barrel alignment guide 200 includes a generally washer shaped front wall 212. Front wall 212 includes projectile aperture 202, and funnel 206 starts generally from aperture 202 and extends radially and proximally to create a barrel guide. As depicted in FIG. 3, the proximal end, i.e. free end 204, of funnel 206 is not in contact with firearm adapter/accessory 203.

Embodiment 300 doesn't require a front wall and instead has lateral wall 312 that attaches to an internal surface of firearm adapter/accessory 303. The attachment may occur through a threaded engagement between the outer surface of firearm barrel alignment guide 300 and the internal surface of firearm adapter/accessory 303. Alternatively, firearm barrel alignment guide 300 may attach to the internal surface of firearm adapter/accessory 303 through any temporary or permanent fastening method known to a person of ordinary skill in the art, including but not limited to welding, adhesives, press fitting, extruding, and mechanical fasteners. Firearm barrel alignment guide 300, however, is preferably temporarily attachable thereby allowing firearm barrel alignment guides with different sized projectile apertures to be secured to firearm adapter/accessory as needed. In an embodiment, firearm barrel alignment guides may be secured to the outer surface of firearm adapter/accessory rather than the internal surface.

Free end 204 creates a degree of flex for funnel 206 about the attachment point of funnel 206 to front wall 212. Alternatively, as depicted in FIG. 4, flanges 306 may be secured to lateral wall 312, such that funnel 306 extends distally and radially, terminating at free end 304. In embodiment 300, the pivot point is further from the point of contact between funnel 306 and barrel 301. In other words, the force is applied a greater distance from the pivot point resulting in greater flexion of funnel 306.

The ability to flex allows the funnel to absorb a greater axial force from barrel 201, which aids in the alignment of barrel 201 and also improves the seal between funnel 206 and the muzzle end of barrel 201. A tighter seal is preferred to prevent gas from escaping towards the proximal end of firearm adapter/accessory 203 when a suppressor extension is not in use. The seal prevents the expanding gases of the muzzle blast from escaping before reaching the suppressor and or suppressor extension. Super-heated and expanding gasses escaping or being directed outward from the barrel end in any direction other than through the muzzle of the barrel or the muzzle of the suppressor, is dangerous because said gas is fast moving, super-heated, expanding, and full of fine un-burned and burned particles from the explosion.

Embodiments 100-300 each include funnels 106-306 with free ends 104-304 to permit flexing of said funnels 106-306. These embodiments may also include a biasing member, such as a spring, to further the objective of sealing the contact between the muzzle of the barrel and the funnel, and aligning the barrel with the projectile aperture. The biasing member may be placed proximally or distally with respect to the funnel to provide a spring force on barrel 101-301 when said barrel contacts funnel 106-306. Alternatively, or in addition to, the funnel may be comprised of a compressible material, such as a synthetic membrane, compressible plastic, or thin metal. Alternatively, the funnel can include a compressible material secured to the barrel contacting surface of the funnel for creating a spring force directed on the muzzle of the barrel. The compressible material can be permanent or an insert that can be replaced as it wears. Moreover, the compressible material preferably has a relatively low coefficient of friction to allow the barrel to easily travel the slope of the funnel into axial alignment with the projectile aperture, and heat resistant properties similar to the funnel.

In an embodiment, funnel 106-306 may include longitudinally extending slots starting at free ends 104-304 and extending towards the opposite ends. The slots preferably create a discontinuous outer perimeter allowing the free ends to splay outwards in a radial direction when subject to the axial force of the barrel.

In an embodiment, funnel 106-306 may include a cutout in the proximal end of firearm barrel alignment guide 100-300. The cutout prevents iron sights on a barrel from preventing the barrel from contacting the funnel, an example of which is depicted in FIG. 7A.

As depicted in FIGS. 5-8, firearm barrel alignment guide 400 includes a frustoconical-shaped bore 422 to guide barrel 401, but may have any curved or angled walls shaped to funnel barrel 401 towards projectile aperture 402 when subject to an axial force causing barrel 401 to contact firearm barrel alignment guide 400. Firearm barrel alignment guide 400 provides extreme flexibility in that it will align any size barrel that falls between the outside diameter of conical bore 422 and the inside diameter of projectile aperture 402.

Figure 6A:
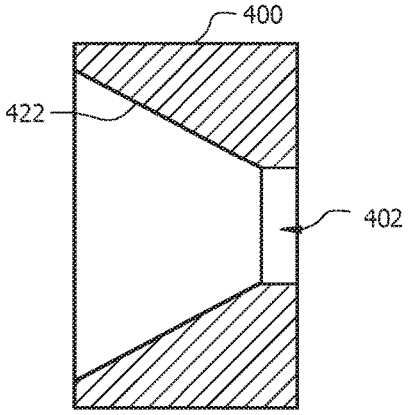
FIG. 6A is a cross-sectional elevation view of an embodiment of the present invention.
Figure 6B:
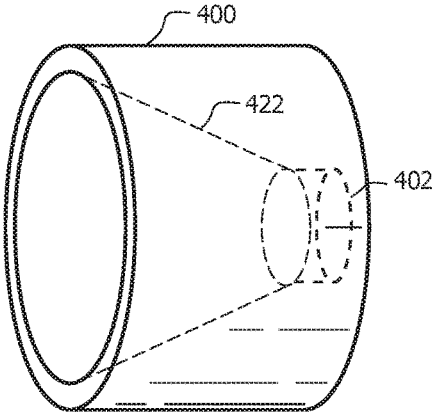
FIG. 6B is a perspective view of the embodiment depicted in FIG. 6A.
Figure 6C:
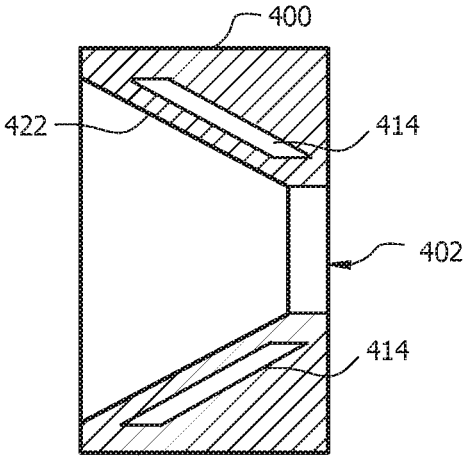
FIG. 6C is a cross-sectional elevation view of an embodiment of the present invention.

As depicted in FIG. 6C, an embodiment includes cavity 414 residing axially and distally behind the internal surface of bore 422. Said embodiment preferably includes a flexible/compressible internal surface or section of the internal surface to allow the bore to flex towards cavity 414. In an embodiment cavity 414 may include a biasing member, such as a spring, to further the objective of creating a seal between the muzzle of the barrel and the funnel, and aligning the barrel with the projectile aperture.

Figure 7A:
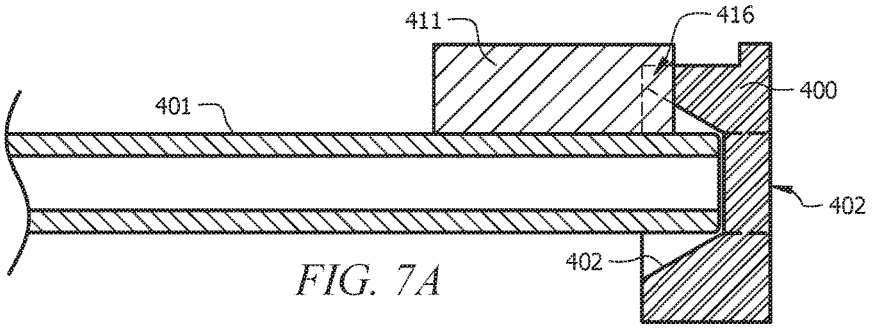
FIG. 7A is a cross-sectional elevation view of an embodiment of the present invention.
Figure 7B:
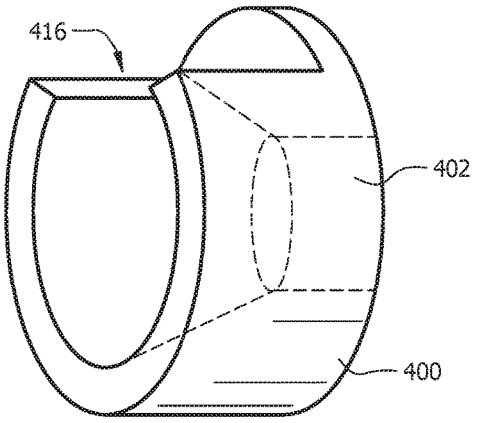
FIG. 7B is a perspective view of the embodiment depicted in FIG. 7A.
Figure 7C:
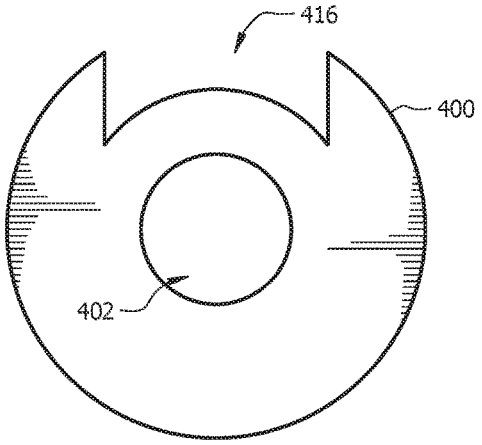
FIG. 7C is an end view of the embodiment depicted in FIG. 7A.

Referring now to FIG. 7, an embodiment of firearm barrel alignment guide 400 includes cutout 416 in the proximal end of firearm barrel alignment guide 400. As shown in FIG. 7A, cutout 416 prevents iron sights 411 on barrel 401 from impeding barrel 401 from contacting internal surface of bore 422. Such an embodiment preferably includes a vertical alignment indicator on firearm barrel alignment guide 400 to inform a user of the location of the cutout 416.

Figure 8A:
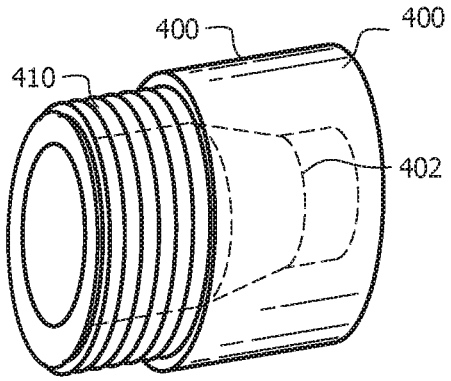
FIG. 8A is a perspective view of an embodiment of the present invention

Referring to FIG. 8, an embodiment of firearm barrel alignment guide 400 may threadedly engage and disengage a firearm accessory/adapter through threads 410. This temporary attachment allows firearm barrel alignment guide 400 to be modified as need to provide a properly sized firearm barrel alignment guide 400 based on the inner and outer diameters of the firearm barrel.

Figure 8B:
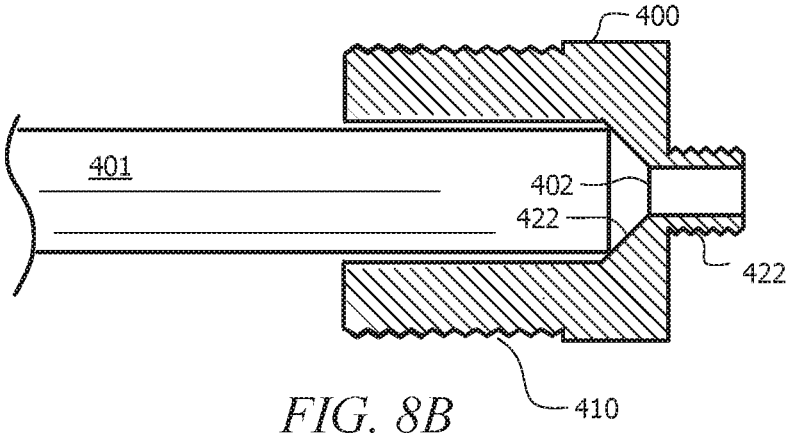
FIG. 8B is a cross-sectional elevation view of an embodiment of the present invention.

As depicted in FIG. 8B, an embodiment may include suppressor attachment 422 on which a suppressor can be attached. Alternatively, a suppressor or suppressor extension can be integrated with the distal end of firearm barrel alignment guide 400.

In an embodiment, the firearm barrel alignment guide includes heat resistant material to withstand the extreme temperatures associated with firing a projectile. The firearm barrel alignment guide is preferably heat resistant at least up to 150 degrees Fahrenheit to compensate for the heating of the barrel when in use. Firearm barrels, however, can reach temperatures in excess of 1300 degrees Fahrenheit. Therefore, an embodiment of the firearm barrel alignment guide is adapted to withstand heat in excess of 1300 degrees Fahrenheit without becoming structurally compromised or melting. There may be several categories of firearm barrel alignment guides based on the rate of fire of the intended firearm. For example, a fully automatic firearm will have the potential to become much hotter than a bolt-action rifle, and therefore, the category of firearm barrel alignment guides for fully automatic firearms will be more heat resistant than the category of firearm barrel alignment guides for single shot firearms.

Figure 9:
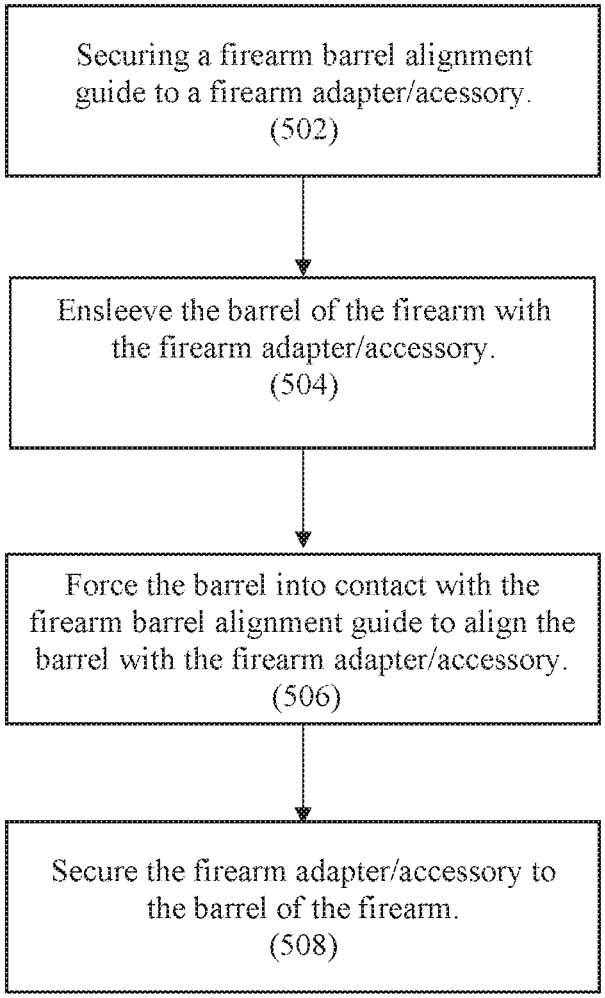
FIG. 9 is a flowchart of an embodiment of the novel method of aligning a firearm barrel with a firearm adapter.

Referring now to FIG. 9, the novel method of aligning a firearm barrel with a firearm adapter/accessory includes securing a firearm barrel alignment guide to the firearm adapter/accessory at step 502, inserting the firearm barrel into the firearm adapter/accessory at step 504, and forcing the firearm barrel towards the firearm barrel alignment guide until the barrel ceases to translate with respect to the firearm adapter/accessory at step 506. At that point the firearm barrel is aligned with the firearm adapter/accessory. The firearm adapter/accessory is then secured to the firearm barrel at step 508.

GLOSSARY OF CLAIM TERMS

Compressible Body: is a body that elastically deforms when subjected to a force.

Firearm Adapter: is a device configured to attach to a firearm, preferably along the barrel of the firearm.

Free End: is an end of a structure that is not fixed or attached to a nearby structure.

Funnel: is a structure that tapers from one end to the other.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A firearm barrel alignment guide, comprising:

a proximal end, a distal end, and a body extending therebetween; a projectile aperture aligned with a longitudinal axis of the body;

the body including a funnel, the funnel having an inner surface that is tapered in a distal direction, wherein a proximal end of the funnel has a lateral expanse that is greater than an outer diameter of a muzzle end of a firearm barrel, such that the proximal end of the funnel is proximally located with respect to the muzzle end of the firearm barrel;

a distal end of the funnel having an inner diameter less than the outer diameter of the firearm barrel and the distal end of the funnel terminating at the projectile aperture; and whereby the inner surface of the funnel directs the firearm barrel into axial alignment with the projectile aperture when a force brings the funnel and the firearm barrel into contact with each other, such that the proximal end of the funnel is proximally located with respect to the muzzle end of the firearm barrel, and the inner surface of the funnel remains in direct contact with the muzzle end of the firearm barrel when the firearm barrel alignment guide is in mechanical communication with the firearm barrel.

2. The firearm barrel alignment guide of claim 1, further including a compressible material disposed on the inner surface of the funnel.

3. The firearm barrel alignment guide of claim 1, wherein the funnel has a free end at the proximal end or the distal end of the funnel, thereby allowing the funnel to flex when subjected to an axial force from the firearm barrel.

4. The firearm barrel alignment guide of claim 1, further including a cavity disposed in the body at a location that is axially and radially distal from the inner surface of the funnel.

5. The firearm barrel alignment guide of claim 1, further including threads on an external surface of the body for attaching to a firearm adapter.

6. A firearm barrel alignment guide assembly, comprising:

a firearm adapter configured to temporarily attach to a firearm;

a barrel alignment guide attached to the firearm adapter, the barrel alignment guide having:

a proximal end, a distal end, and a body extending therebetween;

a projectile aperture aligned with a longitudinal axis of the body;

the body including a funnel, the funnel having a proximal end with a lateral extent greater than an outer diameter of a muzzle end of a firearm barrel and an inner surface that is tapered in a distal direction, such that the funnel directs the firearm barrel into axial alignment with the projectile aperture when a force brings the funnel and the firearm barrel into contact with each other;

a distal end of the funnel having an inner diameter less than the outer diameter of the muzzle end of the firearm barrel and the distal end of the funnel terminating proximate the projectile aperture;

whereby the inner surface of the funnel is in direct contact with the muzzle end of the firearm barrel and the muzzle end of the firearm barrel extends distally beyond the proximal end of the funnel when the firearm adapter is attached to the firearm.

7. The firearm barrel alignment guide assembly of claim 6, further including a compressible material disposed on the inner surface of the funnel.

8. The firearm barrel alignment guide assembly of claim 6, wherein the funnel has a free end at the proximal end or the distal end of the funnel, thereby allowing the funnel to flex when subjected to an axial force from the firearm barrel.

9. The firearm barrel alignment guide assembly of claim 6, further including a cavity disposed in the body at a location that is axially and radially distal from the inner surface of the funnel.

10. The firearm barrel alignment guide assembly of claim 6, wherein the projectile aperture has a diameter that is greater than 0.17 inches.

11. The firearm barrel alignment guide assembly of claim 6, further including threads on the body for attaching to the firearm adapter.

12. A method of aligning a firearm barrel with a firearm adapter, comprising:

mechanically joining a firearm barrel alignment guide to the firearm adapter, the firearm barrel alignment guide including:

a proximal end, a distal end, and a body extending therebetween;

a projectile aperture aligned with a longitudinal axis of the body;

the body including a funnel, the funnel having:

a proximal end with a lateral extent greater than an outer diameter of a muzzle end of the firearm barrel and an inner surface that is tapered in a distal direction;

a distal end of the funnel having a lateral extent less than the outer diameter of the muzzle end of the firearm barrel and the distal end of the funnel terminating proximate the projectile aperture;

bringing the muzzle end of the firearm barrel into direct contact with the inner surface of the funnel and applying an axial force to cause the muzzle end of the firearm barrel to axially align with the projectile aperture, such that the muzzle end of the firearm barrel extends distally beyond the proximal end of the funnel; and securing the firearm adapter to the firearm barrel.

13. The method of claim 12, wherein the inner surface of the funnel is heat resistant up to 1300 degrees Fahrenheit.

14. The method of claim 12, further including measuring the outer diameter of the firearm barrel and selecting the firearm barrel alignment guide with the funnel having a minimum diameter at the proximal end of the funnel that is greater than the outer diameter of the firearm barrel prior to the step of mechanically joining the firearm barrel alignment guide to the firearm adapter.

15. The method of claim 12, wherein a compressible material is disposed on the inner surface of the funnel.

16. The method of claim 12, wherein the funnel has a free end at the proximal or the distal end of the funnel, thereby allowing the funnel to flex when subjected to the axial force from the firearm barrel.

17. The method of claim 12, wherein a cavity is disposed in the body of the firearm barrel alignment guide at a location that is axially and radially distal from the inner surface of the funnel.

18. The method of claim 12, wherein the projectile aperture has a diameter that is greater than 0.17 inches.

19. The method of claim 12, wherein the step of mechanically joining the firearm barrel alignment guide to the firearm adapter includes threading the firearm barrel alignment guide to the firearm adapter.

* * * * *